US011473250B2

(12) United States Patent
Schenkelberg

(10) Patent No.: US 11,473,250 B2
(45) Date of Patent: Oct. 18, 2022

(54) PLACER SPREADER WITH ADJUSTABLE STRIKE OFF

(71) Applicant: Wirtgen GmbH, Windhagen (DE)

(72) Inventor: Kevin Schenkelberg, Hartenfels (DE)

(73) Assignee: Wirtgen GmbH

( * ) Notice: Subject to any disclaimer, the term of this patent is extended or adjusted under 35 U.S.C. 154(b) by 153 days.

(21) Appl. No.: 17/004,452

(22) Filed: Aug. 27, 2020

(65) Prior Publication Data

US 2021/0222377 A1 Jul. 22, 2021

Related U.S. Application Data

(60) Provisional application No. 62/963,905, filed on Jan. 21, 2020.

(51) Int. Cl.
*E01C 19/18* (2006.01)
*E01C 19/48* (2006.01)

(52) U.S. Cl.
CPC ..... *E01C 19/187* (2013.01); *E01C 19/185* (2013.01); *E01C 19/4893* (2013.01); *E01C 2301/14* (2013.01); *E01C 2301/16* (2013.01)

(58) Field of Classification Search
CPC .. E01C 19/185; E01C 19/187; E01C 19/4893; E01C 2301/14; E01C 2301/16
USPC ..... 404/72, 75, 101–110, 118
See application file for complete search history.

(56) References Cited

U.S. PATENT DOCUMENTS 3,221,618 A 12/1965 Hudis
3,225,668 A 12/1965 Maginniss
3,267,824 A 8/1966 Hudis
3,327,368 A 6/1967 Russo et al.
3,540,359 A * 11/1970 Swisher, Jr. ..... E01C 19/185 404/110
3,552,546 A 1/1971 Rath
4,323,321 A * 4/1982 Dale ..... E01C 19/407 404/105
6,332,736 B1 * 12/2001 Cape ..... B65G 69/0408 222/533
6,471,442 B1 * 10/2002 Deeb ..... E01C 19/40 404/96
7,311,465 B2 12/2007 Guntert, Jr. et al.
7,316,522 B2 1/2008 Guntert, Jr. et al.
7,753,619 B2 7/2010 Guntert, Jr. et al.
9,969,427 B1 * 5/2018 Engels ..... E01C 19/187
10,253,461 B2 * 4/2019 Engels ..... E01C 19/4893
2006/0204335 A1 9/2006 Guntert et al.
(Continued)

OTHER PUBLICATIONS

Gomaco PS-2600 Placer/Spreader brochure (8 pages)(See p. 7 re "Strike-Off" power transition adjuster) (2016).
(Continued)

*Primary Examiner* — Raymond W Addie
(74) *Attorney, Agent, or Firm* — Lucian Wayne Beavers; Patterson Intellectual Property Law, PC

(57) ABSTRACT

A strike off assembly for a placer spreader apparatus includes a strike off support beam and left and right side plate assemblies attached to ends of the support beam. A strike off plate assembly includes a left strike off plate portion and a right strike off plate portion pivotably connected together. A plurality of strike off actuators are connected to the strike off plate assembly and configured to raise and lower the strike off plate assembly relative to the support beam to vary a height of a material placement space.

27 Claims, 13 Drawing Sheets

(56) References Cited

U.S. PATENT DOCUMENTS

| | | | | |
|---|---|---|---|---|
| 2008/0044226 | A1 | 2/2008 | Guntert et al. | |
| 2010/0129151 | A1 | 5/2010 | Guntert, Jr. et al. | |
| 2016/0245785 | A1* | 8/2016 | Marsolek | E01C 19/48 |
| 2018/0155883 | A1* | 6/2018 | Engels | E01C 19/4893 |
| 2019/0382967 | A1* | 12/2019 | Kleinvachter | E01C 19/48 |

OTHER PUBLICATIONS

Gomaco PS-2600 Placer Mold Partsbook (67 pages)(See p. 58 re Ta Mount Assembly)(Oct. 27, 2016).
Gomaco PS-2600-NG Belt Placer/Spreader Partsbook (365 pages)(May 27, 2010).
Gomaco Techical Data—2008 PS-2600 Placer/Spreader (p. 145-153)(2008).
CMI/TEREX Spareparts Catalog Strikeoff Mold (p. 35-52)(undated but admitted to be prior art).
Gomaco PS2600 power transition adjuster photo (1 page)(undated but admitted to be prior art).
Partial European Search Report for corresponding patent application No. EP 21 15 2579, dated Jun. 30, 2021, 4 pages (not prior art).
Guntert & Zimmerman Const. Div., Inc.: "PS1200—Base & Concrete Placer Spreader", Nov. 26, 2019, XP002803306; URL: http.://web.archive.org/web/20191126111719/http://www.guntert.com/news/library/UPDATE91216/PS1200WEB.pdf.

* cited by examiner

PLACER SPREADER WITH ADJUSTABLE STRIKE OFF

BACKGROUND OF THE INVENTION

1. Field of the Invention

The present disclosure relates generally to a placer spreader apparatus for placing and spreading concrete ahead of a slip form paving machine.

2. Description of the Prior Art

Typical placer spreader machines use a strike off assembly which is fixed to the main frame of the placer spreader machine such that the height of the strike off assembly is adjusted by raising and lowering the main frame of the placer spreader machine.

There is a need for improved placer spreader machines providing greater flexibility in their operation.

SUMMARY OF THE INVENTION

In one embodiment a strike off assembly for a placer spreader apparatus may include a strike off support beam including left and right beam ends, the support beam having a length between the beam ends. Left and right side plate assemblies are configured to close off lateral sides of a material placement space. A strike off plate assembly may include a left strike off plate portion and a right strike off plate portion, the left and right strike off plate portions being pivotable relative to each other and relative to the support beam about at least one pivot axis. A plurality of strike off actuators may be connected to the strike off plate assembly and configured to raise and lower the strike off plate assembly relative to the support beam to vary a height of the material placement space.

The plurality of strike off actuators may include a left end actuator for raising and lowering a left laterally outer end of the strike off plate assembly relative to the support beam, a right end actuator for raising and lowering a right laterally outer end of the strike off plate assembly relative to the support beam, and a center actuator for raising and lowering a center of the strike off plate assembly.

In any of the above embodiments the laterally inner ends of the left and right strike off plate portions may be pivotally connected to each other at a pivot connection defining the at least one pivot axis, and the center actuator may be configured to raise and lower the pivot connection relative to the support beam.

In any of the above embodiments each of the actuators may be operable independently of the others.

Any of the above embodiments may further include a left end actuator extension sensor associated with the left end actuator and configured to generate a left end extension signal representative of an extension distance of the left end actuator, a right end actuator extension sensor associated with the right end actuator and configured to generate a right end extension signal representative of an extension distance of the right end actuator, and a center actuator extension sensor associated with the center actuator and configured to generate a center extension signal representative of an extension distance of the center actuator.

In any of the above embodiments each of the actuators may include a hydraulic piston-cylinder unit, and each actuator extension sensor may be integrally located within its respective hydraulic piston-cylinder unit.

Any of the above embodiments may further include a controller configured to receive the extension signals from the actuator extension sensors and to generate control signals for each of the actuators based at least in part on the extension signal of its respective extension sensor and based at least in part on target values corresponding to a user selected profile for the height of the material placement space.

In any of the above embodiments the target values may include a home position mode wherein the controller returns each of the actuators to a preset home position.

In any of the above embodiments the target values may include a crowning mode wherein the controller is configured to vary a relative height between the center of the strike off plate assembly and the laterally outer ends of the strike off plate assembly to form a crown or a trough in the material placement space.

In any of the above embodiments the target values may include an incline mode wherein the controller is configured to laterally incline the strike off plate assembly relative to the support beam.

In any of the above embodiments the target values may include an adjustment of the extension distance of one or more of the actuators directed by a human operator.

In any of the above embodiments the controller may further include a remote control unit configured such that the human operator can control the strike off assembly from a paving machine following the placer spreader apparatus or from any other remote location.

In any of the above embodiments the strike off support beam may be a telescoping strike off support beam such that the length of the beam is adjustable.

In any of the above embodiments each of the left and right strike off plate portions may include a plurality of removable strike off segments so that a lateral length of each of the left and right strike off plate portions can be varied by removing or adding a segment.

Any of the above embodiments may further include a plurality of strike off segment guide brackets removably attached to the telescoping strike off support beam, each guide bracket including a downward extending member spaced forward from the support beam to define a guide gap between the support beam and the downward extending member, the guide gaps associated with each of the plurality of strike off segment guide brackets being aligned in a lateral direction parallel to the length of the support beam, wherein the strike off plate assembly is received in the guide gaps.

Any of the above embodiments may further include a spreading auger located forward of the strike off plate assembly for spreading material laterally in front of the strike off plate assembly, and a lateral conveyor including a receiving portion laterally offset from the strike off plate assembly for receiving the material from a transfer vehicle, and including a discharge portion located forward of the spreading auger for discharging the material onto a ground surface forward of the spreading auger and laterally between the left and right side plate assemblies. Alternatively, a spreading plow may be used instead of a spreading auger.

Any of the above embodiments may further include a tractor including a main frame, a plurality of ground engaging units for supporting the main frame from the ground surface, and a plurality of lifting columns extending between the ground engaging units and the main frame for adjusting a height of the main frame relative to the ground surface. The support beam may be supported directly or indirectly from the main frame so that a height of the support beam is adjustable in height relative to the ground surface with the main frame. The strike off assembly may further include a plurality of actuator extension sensors, each sensor being associated with at least one of the actuators and configured to generate an extension signal representative of an extension distance of its respective actuator. A controller may be configured to receive the extension signals from the extension sensors, and to control the extension distances of the actuators to thereby control a height of the strike off plate assembly relative to the support beam at least in part in response to the extension signals and based at least in part on target values corresponding to a user selected profile for the height of the strike off plate assembly relative to the support beam.

In another embodiment a strike off assembly for a placer spreader apparatus may include a telescoping strike off support beam including left and right beam ends, the support beam having an adjustable length between the beam ends. Left and right side plate assemblies may be attached to the left and right beam ends. A plurality of strike off segment guide brackets may be attached to the strike off support beam, each guide bracket including a downward extending member spaced forward from the support beam to define a guide gap between the support beam and the downward extending member, the guide gaps associated with each of the plurality of strike off segment guide brackets being aligned in a lateral direction parallel to the length of the support beam. A strike off plate assembly may be received in the guide gaps.

In the above embodiment the telescoping strike off support beam may include a center beam portion including upper and lower laterally extending cavities, a left beam portion telescopingly received in one of the cavities and a right beam portion telescopingly received in the other of the cavities.

In either of the two immediately above embodiments a plurality of strike off actuators may be connected to the strike off plate assembly and configured to raise and lower the strike off plate assembly within the guide gaps relative to the support beam.

In any of the three immediately above embodiments the strike off plate assembly may include a left strike off plate portion and a right strike off plate portion, the left and right strike off plate portions being pivotable relative to each other and relative to the support beam. The plurality of strike off actuators may include a left end actuator for raising and lowering a left laterally outer end of the left strike off plate portion relative to the support beam, a right end actuator for raising and lowering a right laterally outer end of the right strike off plate portion relative to the support beam, and a center actuator for raising and lowering laterally inner ends of the left and right strike off plate portions relative to the support beam.

In any of the four immediately above embodiments the plurality of strike off actuators may be configured to vary a relative height between the laterally inner ends of the left and right strike off plate portions and the left and right laterally outer ends of the left and right strike off plate portions to form a crown or a trough in a material placement space.

In any of the five immediately above embodiments each of the left and right strike off plate portions may include a plurality of removable strike off segments so that a length of each of the left and right strike off plate portions can be varied by removing or adding a segment.

In another embodiment a method of coordinating operation of a slip form paving machine and a placer spreader machine, may comprise the steps of:

(a) providing a paving train including the placer spreader machine followed by the slip form paving machine, each of the placer spreader machine and the slip form paving machine including a machine frame, a plurality of ground engaging units, and a plurality of lifting columns supporting the respective machine frame from the respective plurality of ground engaging units;

(b) guiding each of the slip form paving machine and the placer spreader machine along a common path and controlling a machine frame height of each of the machine frames based upon a common external position reference;

(c) operating the slip form paving machine with a human operator located on the slip form paving machine; and (d) remotely adjusting a height of a strike off plate assembly of the placer spreader machine relative to the machine frame of the placer spreader machine via a remote control operated by the human operator located on the slip form paving machine.

In the above embodiment in step (b) the common external position reference may include a stringline fixed relative to the ground surface.

In either of the two immediately above embodiments in step (d) the adjusting of the height of the strike off plate assembly may include forming a crown or a trough in a material placement space.

In any of the three immediately above embodiments in step (d) the adjusting of the height of the strike off plate assembly may include forming an incline in a material placement space.

Numerous objects, features and advantages of the present invention will be readily apparent to those skilled in the art upon reading of the following disclosure when taken in conjunction with the accompanying drawings.

DETAILED DESCRIPTION

Figure 1:
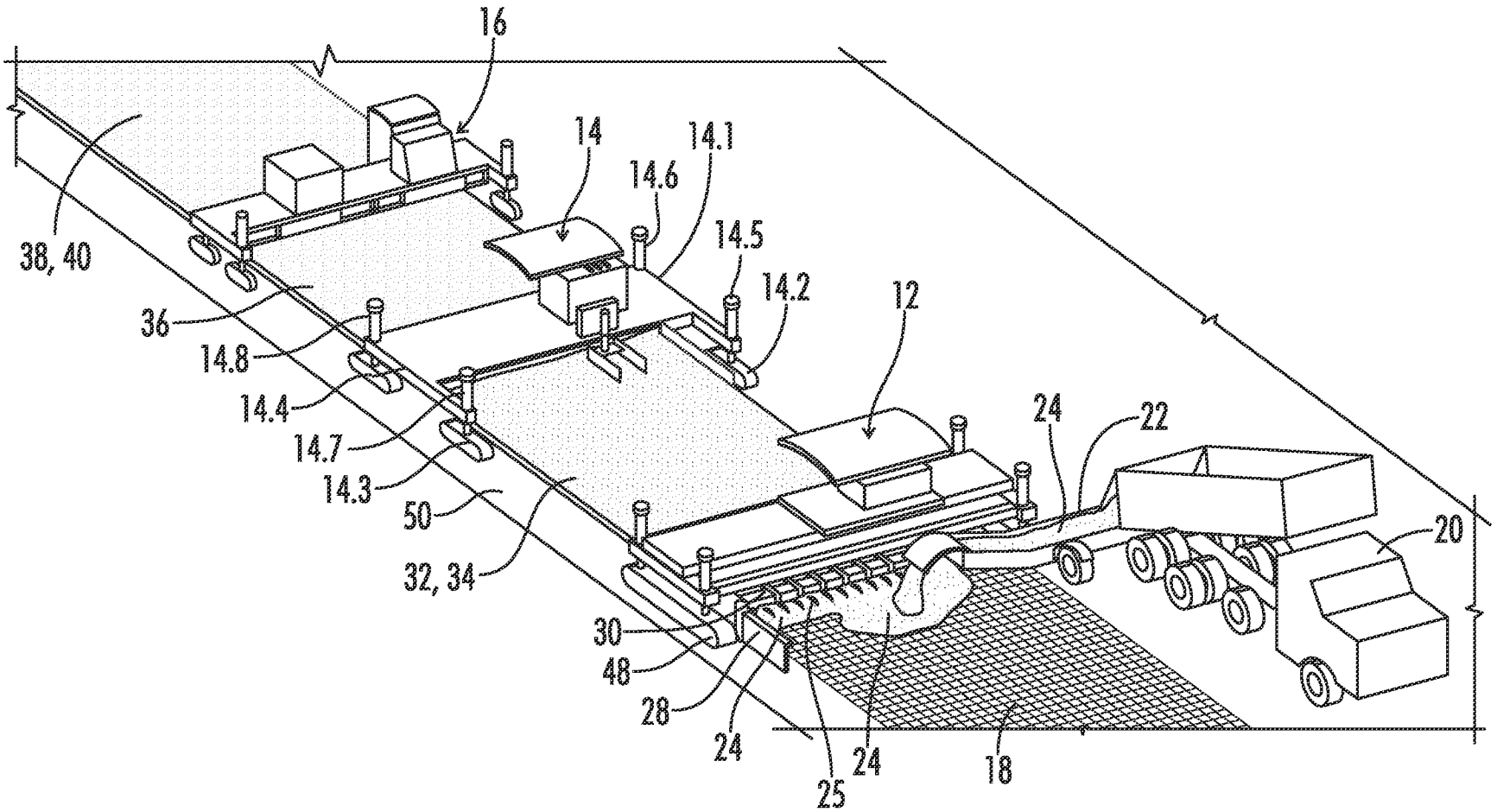
FIG. 1 is a schematic perspective view of a paving train including a placer spreader machine followed by a slip form paving machine followed by a texturing and curing machine.

FIG. 1 schematically illustrates a paving train 10 which includes a placer spreader machine 12, followed by a slip form paving machine 14, followed by a texturing and curing machine 16. A network of steel reinforcing 18 has already been constructed in the path to be paved. Because of the steel reinforcing in the path of the paving it is not possible for concrete supply trucks to dump the concrete directly in the path.

A concrete supply truck 20 is shown off to one side of the placer spreader machine 12 dumping concrete material 24 onto a lateral conveyor 22 of the placer spreader machine 12. The lateral conveyor 22 dumps the concrete material 24 in front of a spreading auger 25 of the placer spreader machine 12. The spreading auger 25 spreads the pile of concrete material 24 laterally outward towards left and right side plate assemblies 26 and 28 of the placer spreader machine 12. A strike off assembly 30 behind the spreading auger 25 forms a top surface 34 of a rough formed concrete structure 32.

The slip form paving machine 14 which follows behind the placer spreader machine 12 then does a much finer forming of the rough formed concrete structure 32 into a fine formed concrete structure 36. The paving machine 14 also consolidates the concrete. The slip form paving machine 14 may include a machine frame 14.1 and a plurality of ground engaging units such as 14.2, 14.3 and 14.4. The machine frame 14.1 may be supported from the ground engaging units by a plurality of lifting columns 14.5, 14.6, 14.7 and 14.8.

The texturing and curing machine 16 then applies a texture and/or sprays curing liquid on a textured top surface 38 of the final concrete structure 40.

Figure 2:
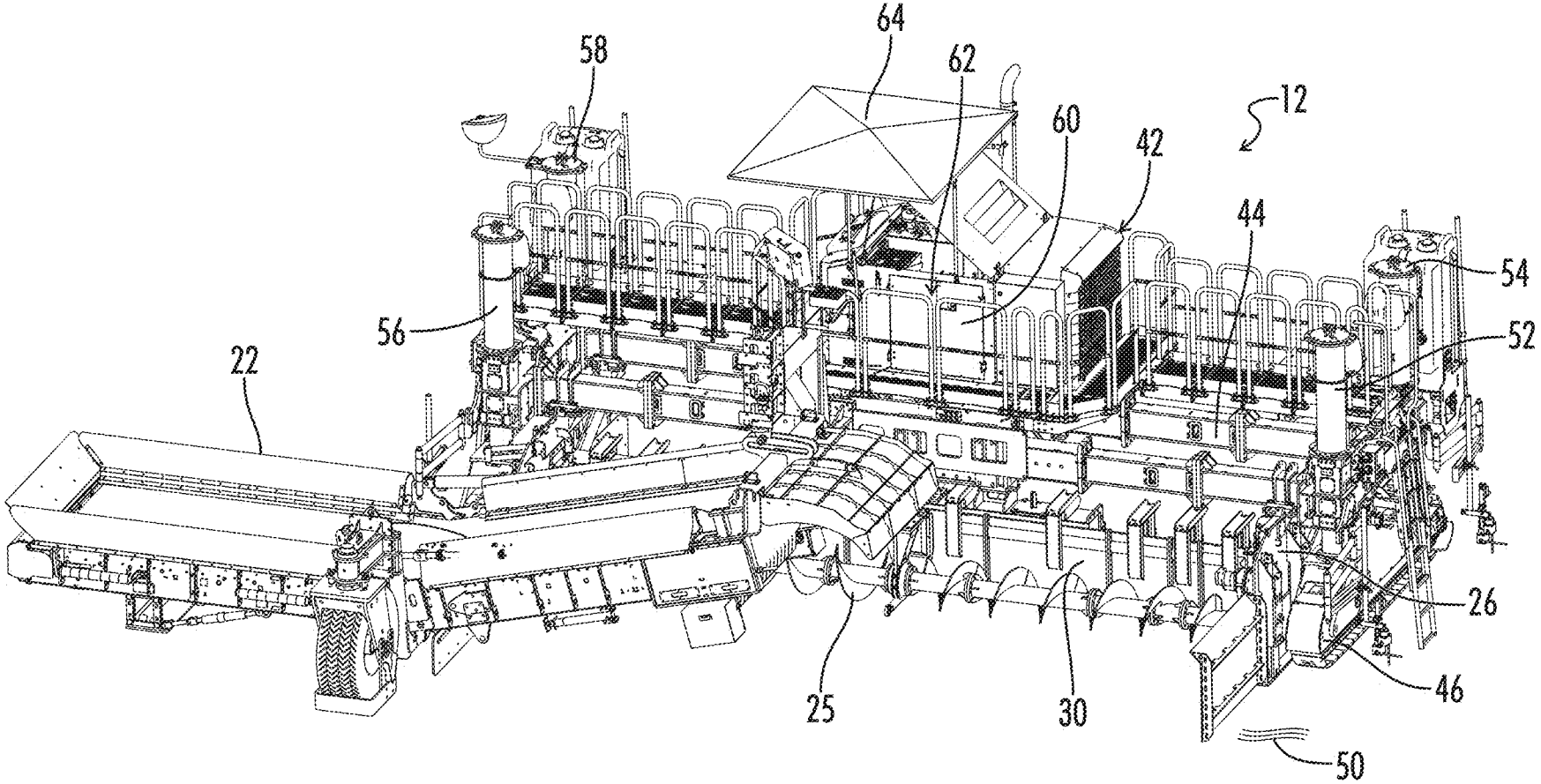
FIG. 2 is a left front perspective view of the placer spreader machine.

The details of the placer spreader machine 12 are further shown in FIG. 2 which is a front perspective view taken slightly from the left side. It is noted that as used in the present application the terms left and right indicate lateral directions from the viewpoint of an operator on board the respective machine and facing forward. Thus in FIGS. 1-3 which are front views, references to left and right sides of the placer spreader machine 12 are reversed as compared to the left and right sides of the figure.

In FIG. 2 the lateral conveyor 22 is shown arranged for loading of the conveyor from a truck 20 located to the right of the placer spreader machine 12, whereas in FIG. 1 the lateral conveyor 22 was arranged for loading of the conveyor from a truck 20 located to the left of the placer spreader machine 12. It will be understood that the lateral conveyor 22 can be located on either side of the placer spreader machine 12. As best seen in FIG. 3A the lateral conveyor 22 is a foldable conveyor having a laterally inner discharge portion 22.1 and a laterally outer receiving portion 22.2 which are pivotally connected together. A forward support wheel 22.3 partially supports the conveyor 22. A pair of supporting hydraulic cylinders 22.4, one of which is seen in FIG. 3A, support the laterally outer portion 22.2. A pair of folding hydraulic cylinders 22.5, one of which is seen in FIG. 3A, fold the laterally outer portion 22.2 upwards to a vertical position. This vertical position of the laterally outer portion 22.2 allows the laterally outer portion 22.2 to be moved out of the way of the dump truck 20 so the dump truck 20 can move past the placer spreader machine 12 into or out of the position shown in FIG. 1. A deflector 22.6 is pivotally attached to the laterally inner end of conveyor 22 and its deflection angle is controlled with a hydraulic cylinder 22.7.

Referring back to FIG. 2, the placer spreader machine 12 includes a tractor unit 42 having a main frame or machine frame 44. Left and right ground engaging units 46 and 48, which in the illustrated embodiment are crawler tracks, support the placer spreader machine 12 from the ground surface 50. The main frame 44 is supported from the left ground engaging unit 46 by left front and left rear lifting columns 52 and 54, respectively. The main frame 44 is supported from the right ground engaging unit 48 by right front and right rear lifting columns 56 and 58, respectively.

The main frame 44 may be a laterally telescoping frame which allows the distance between the left and right ground engaging units 46 and 48 to be adjusted. The lateral adjustment of the width of the main frame 44 may be adjusted via hydraulic actuators (not shown) located within the main frame 44.

Figure 3:
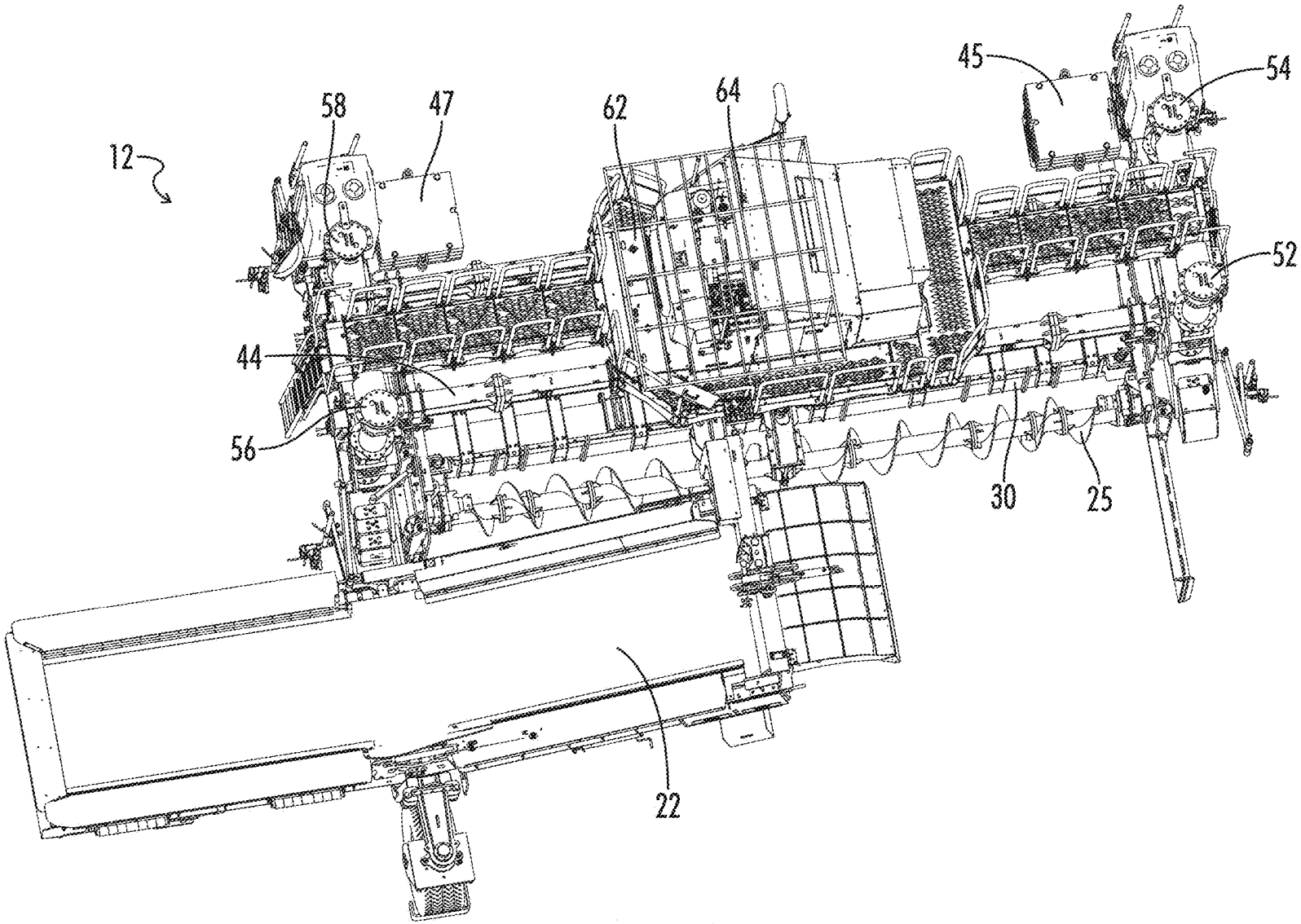
FIG. 3 is a plan view of the placer spreader machine.
Figure 3A:
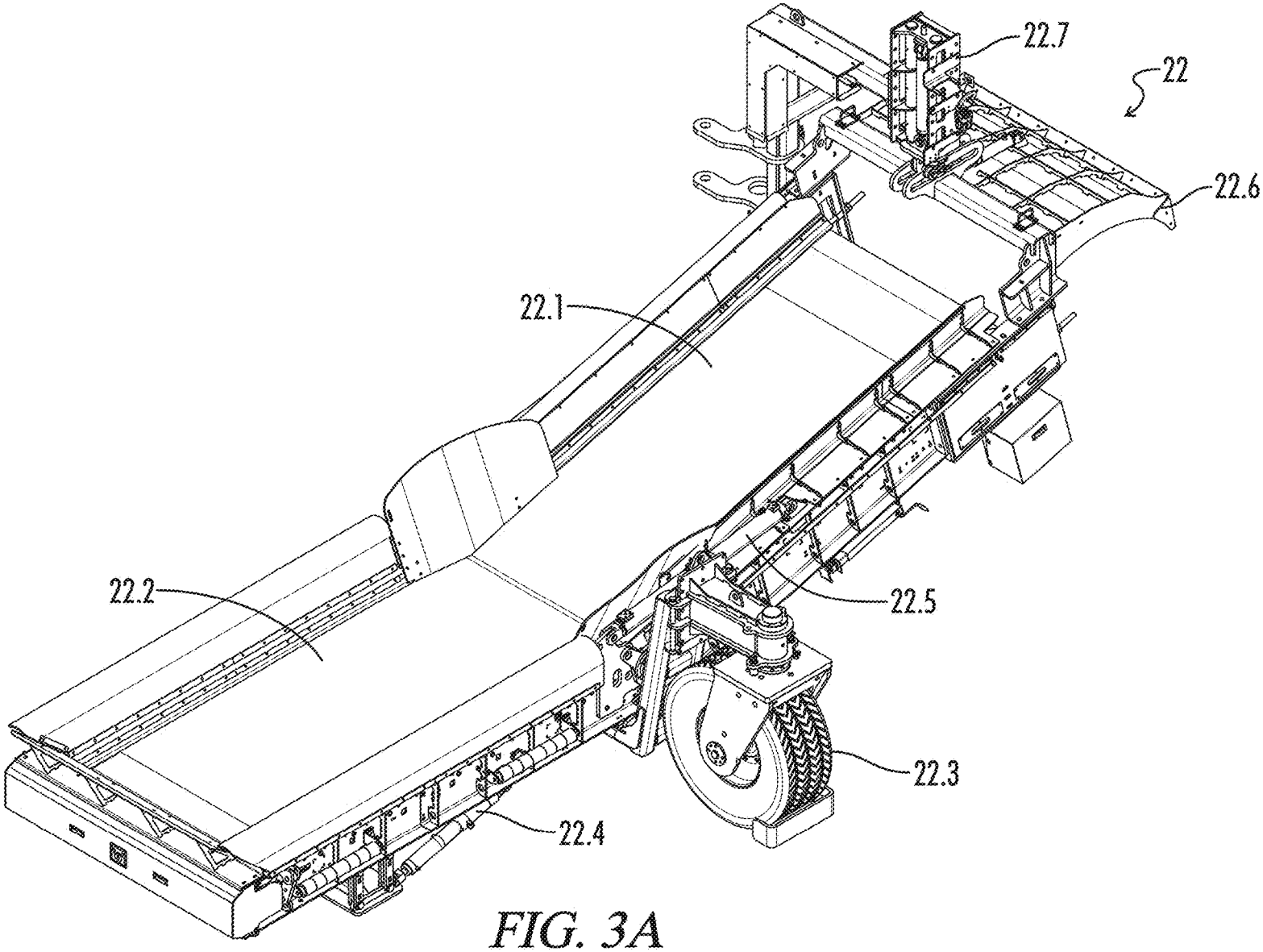
FIG. 3A is an enlarged view of the foldable lateral conveyor.

As can be seen in FIG. 3, the strike off assembly 30 cantilevers forward from the main frame 44. To balance the loading on the main frame 44 counterweights 45 and 47 may be attached to the rear of the main frame 44.

The tractor unit 42 includes a power source 60 which may for example be an internal combustion engine. The power source 60 may drive a series of hydraulic pumps (not shown) which provide hydraulic power to the various components of the placer spreader machine 12. Such hydraulic power is provided to hydraulic motors of the ground engaging units 46 and 48 to propel the placer spreader machine 12 across the ground surface 50. Hydraulic power is also provided to hydraulic cylinders (not shown) located within each of the lifting columns 52, 54, 56 and 58 to adjust a height of the main frame 44 relative to the ground engaging units 46 and 48 and relative to the ground surface 50.

An operator's platform 62 is supported on the main frame 44 and may be covered by a canopy 64. A human operator may be located on the operator's platform 62 and control the operation of the placer spreader machine 12. As is further explained below, the height of the strike off plate assembly 104 of the placer spreader machine 12 may also be operated remotely, such as by the operator of the slip form paving machine 14 which follows the placer spreader machine 12.

Figure 4:
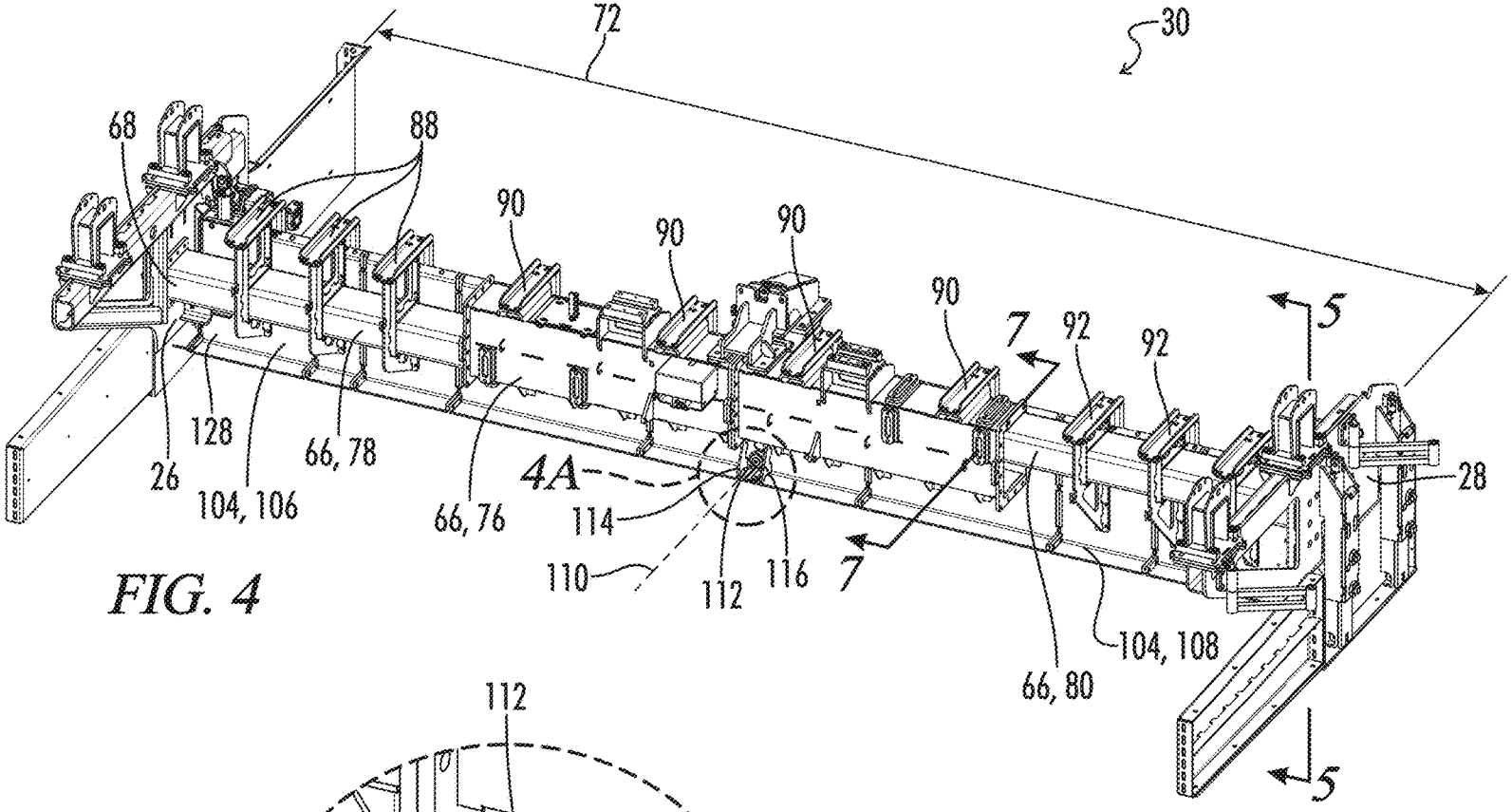
FIG. 4 is a rear perspective view of the strike off assembly of the placer spreader machine of FIGS. 2 and 3.
Figure 4A:
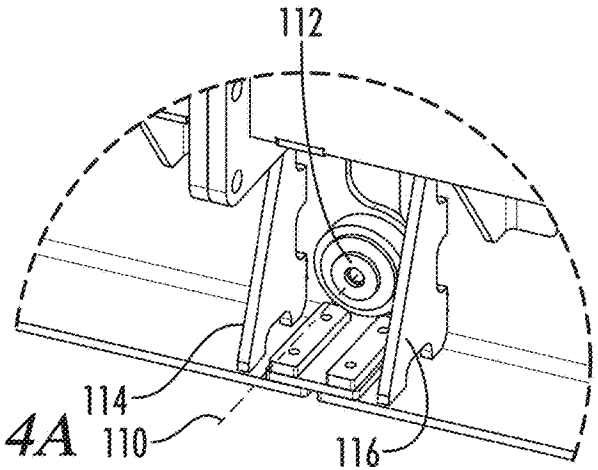
FIG. 4A is an enlarged view of the center pivot connection of the strike off assembly of FIG. 4.

The strike off assembly 30 is shown in isolation in FIG. 4, which is a rear perspective view of the strike off assembly 30. Thus with reference to FIG. 4 references to left and right are consistent with the left and right sides of the figure. Strike off assembly 30 includes a telescoping strike off support beam 66 including left and right beam ends 68 and 70. The support beam 66 has a length 72 between ends 68 and 70. The left and right side plate assemblies 26 and 28 are attached to the left and right beam ends 68 and 70, respectively and are configured to close off lateral sides of a material placement space 74 (see FIGS. 9 and 10) defined by the strike off assembly 30. The support beam 66 is supported from the main frame 44 so that the strike off assembly 30 is raised and lowered with the main frame 44 by action of the lifting columns 52, 54, 56 and 58.

Figure 7:
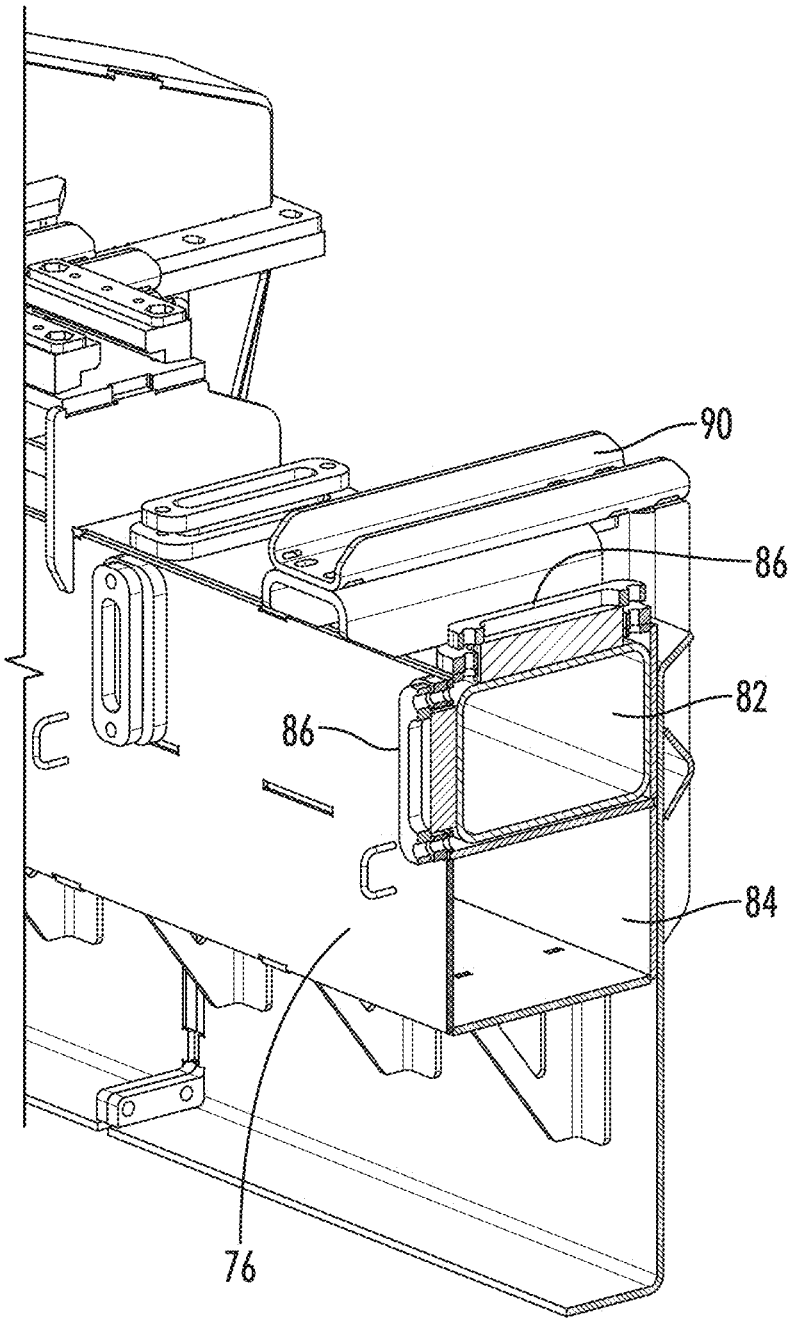
FIG. 7 is a rear perspective end view of the right end of the center portion of the telescoping strike off support beam, showing clamps for clamping the right sliding beam portion of the telescoping strike off support beam in a selected extended position.

The telescoping support beam 66 includes a center beam portion 76, and left and right sliding beam portions 78 and 80. The center beam portion 76 may have a rectangular cross-section defining upper and lower rectangular cross-section laterally extending cavities 82 and 84 (see FIG. 7) in which the left and right sliding beam portions 78 and 80, respectively, are slidingly received. A plurality of clamps 86 are attached to the center beam portion 76 by threaded screws and the clamps 86 can be tightened against the sliding left and right beam portions 78 and 80 to lock the sliding beam portions in place relative to the center beam portion 76.

In the embodiment illustrated the left and right side plate assemblies 26 and 28 are directly attached to the main frame 44 and the center beam portion 76 is directly attached to the main frame 44. And as previously noted the left and right beam ends 68 and 70 are attached to the left and right side plate assemblies 26 and 28. Alternatively the left and right beam ends 68 and 70 can also be supported directly from the main frame 44 instead of being attached to the side plate assemblies. In either case the support beam 66 is supported from the main frame, either directly or indirectly.

The telescoping support beam 66 may include an internal actuator to power the telescoping action, or it may achieve its telescoping action simply by unlocking the clamps 86 and allowing the telescoping support beam to be extended or retracted as the main frame 44 to which it is attached is extended or retracted.

Figure 5:
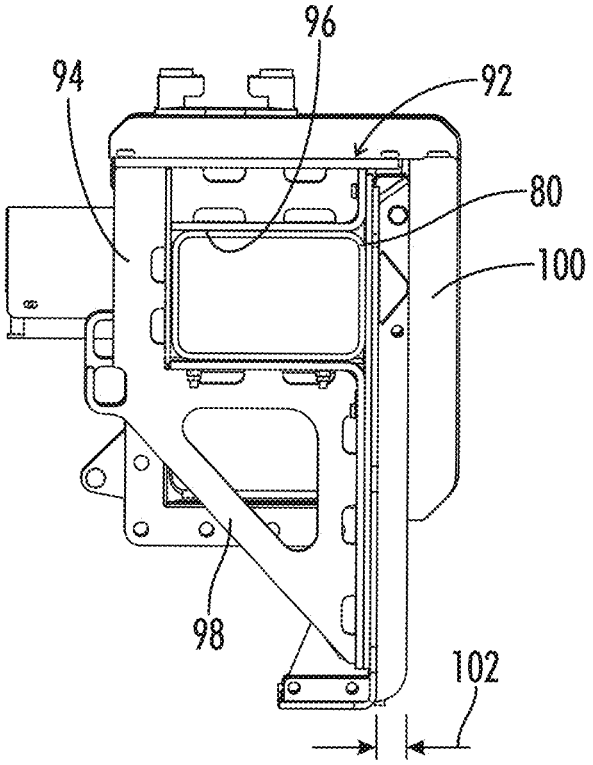
FIG. 5 is an elevation sectioned view along line 5-5 of FIG. 4 through the telescoping strike off support beam.
Figure 6:
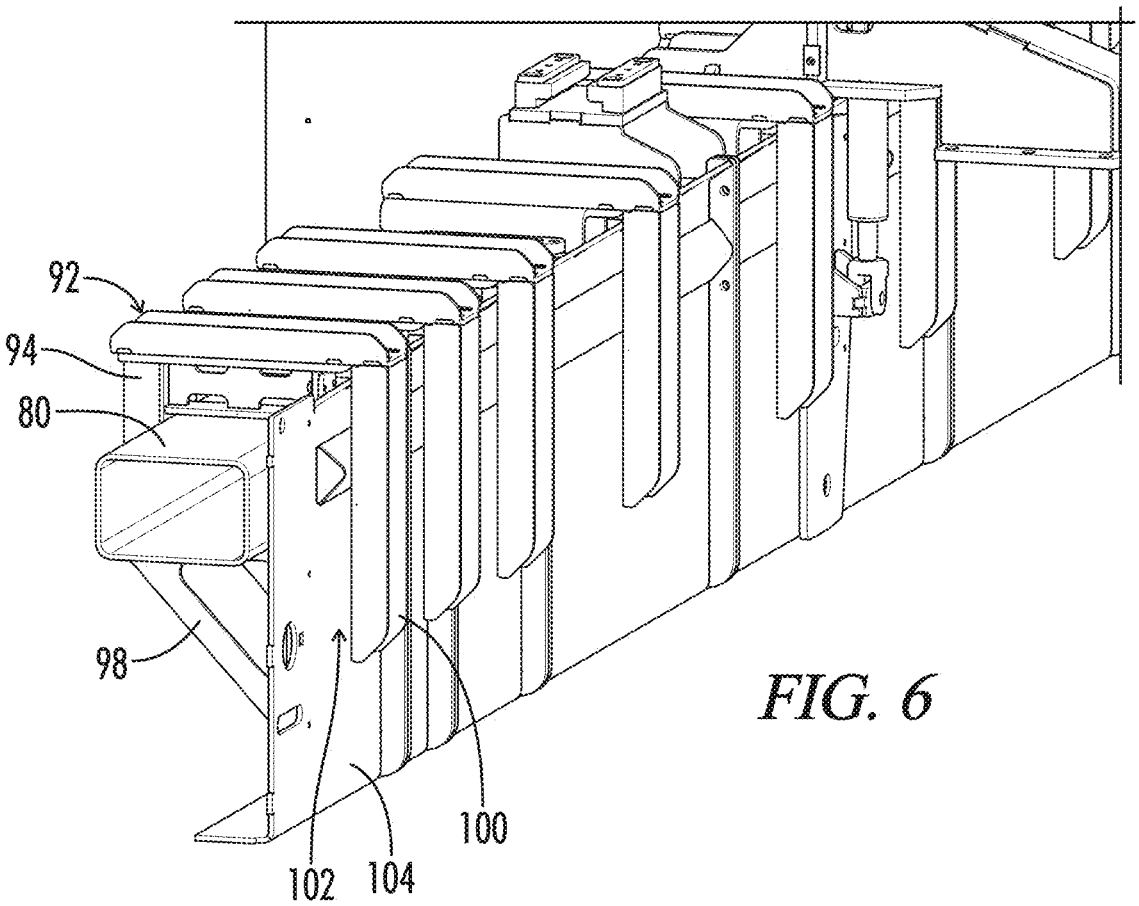
FIG. 6 is a perspective view of the sectioned end of the telescoping strike off support beam of FIG. 5.

As best seen in FIGS. 4-6 a plurality of left, center, and right strike off segment guide brackets 88, 90 and 92, respectively, are removably attached to the strike off support beam 66. It will be appreciated that due to the differing shapes of the left sliding beam portion 78, center beam portion 76 and right sliding beam portion 80, there are slight differences in the shapes of the three groups of guide brackets to fit on their respective beam portions.

The details of construction of one of the right strike off segment guide brackets 92 are seen in FIGS. 5 and 6. Each guide bracket 92 includes an upper portion 94 having a generally rectangular opening 96 formed therein for closely fitting about the right sliding beam portion 80. Guide bracket 92 further includes a lower generally triangular reinforcing portion 98 extending below the upper portion 94. Guide bracket 92 further includes a downward extending member 100 spaced forward from the upper and lower portions 94 and 98 to define a guide gap 102 between the support beam 66 and the downward extending member 100. The guide gaps 102 associated with each of the plurality of strike off segment guide brackets are aligned in a lateral direction parallel to the length of the support beam 66.

Figure 9:
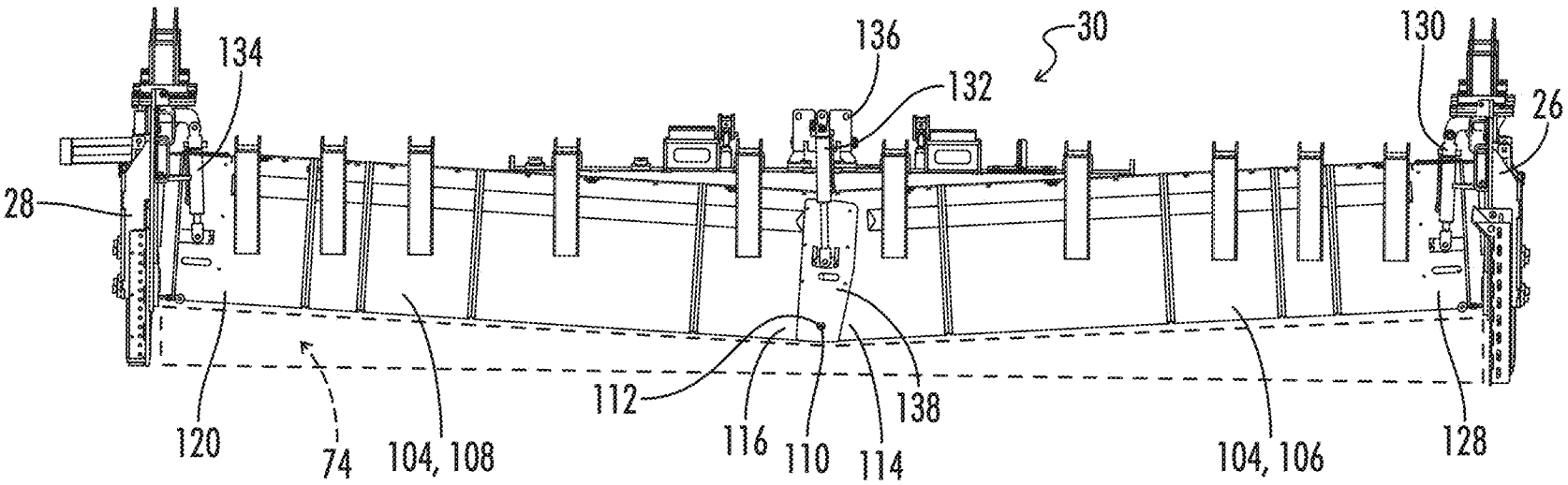
FIG. 9 is a front elevation view of the strike off assembly of the placer spreader machine of FIGS. 2-4, showing a center of the strike off assembly lowered relative to the lateral ends of the strike off assembly to form a trough in a material placement space.
Figure 10:
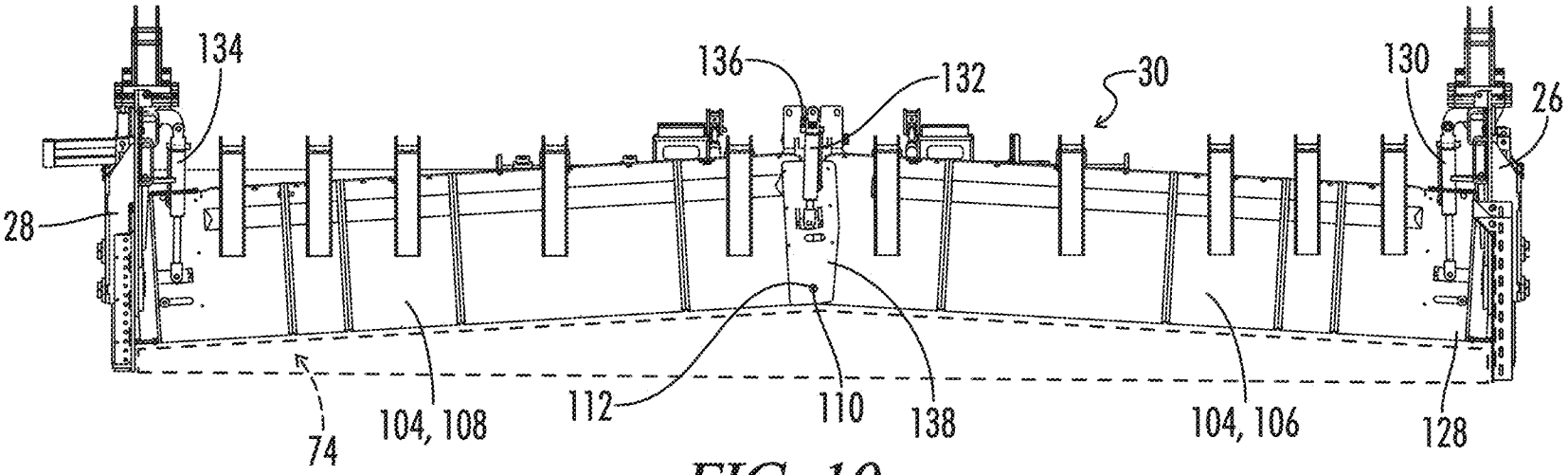
FIG. 10 is a front elevation view of the strike off assembly of the placer spreader machine similar to FIG. 9, showing a center of the strike off assembly raised relative to the lateral ends of the strike off assembly to form a crown in the material placement space.

The strike off assembly 30 includes a strike off plate assembly 104 received in the aligned guide gaps 102. As is further explained below the guide gaps 102 guide upward and downward motion of the strike off plate assembly 104 relative to the support beam 66. The strike off plate assembly 104 includes a left strike off plate portion 106 and a right strike off plate portion 108. The left and right strike off plate portions 106 and 108 are pivotable relative to each other and relative to the support beam 66 about at least one pivot axis 110. As best seen in FIGS. 4, 9 and 10 the pivot axis 110 is defined by a pivot pin 112 connecting laterally inner ends 114 and 116 of the left and right strike off plate portions 106 and 108, respectively.

Figure 8:
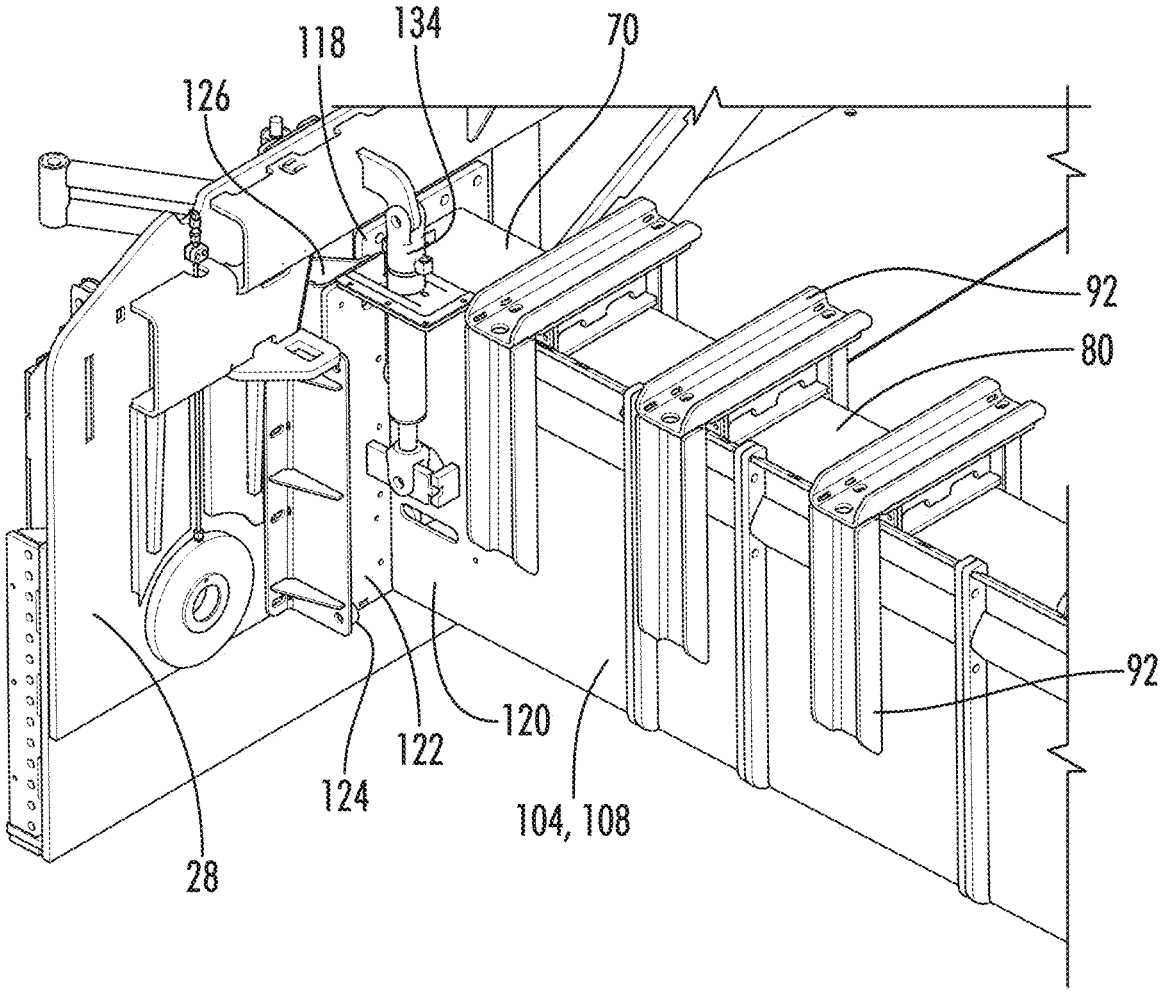
FIG. 8 is a front perspective view of the right side plate assembly and the right end of the strike off assembly.

As can be seen in FIG. 8, the right end 70 of right sliding beam portion 80 includes a flange 118 which is bolted to the right side plate assembly 28. The right strike off plate portion 108 includes a right laterally outer end 120, which can also be described as a right laterally outer end 120 of the strike off plate assembly 104. The right laterally outer end 120 includes a guide flange 122 which is located laterally outward of a laterally inner guide wheel 124 which is attached to the side plate assembly 28. A similar outer guide wheel (not shown) is located laterally outward of the guide flange 122. The guide flange 122 has a vertically extending elastomeric seal member 126 attached thereto which seals against the right side plate assembly 28. Thus the strike off plate assembly 104 can slide up and down relative to the side plate assembly 28 and the telescoping support beam 66, while the elastomeric seal member 126 maintains a seal between the strike off plate assembly 104 and the right side plate assembly 28. Also as is further described below, when the width of the placer spreader machine is adjusted, the entrapment of the guide flange 122 between the two guide wheels will move the right strike off plate portion 108 laterally inward or outward with the right side plate assembly 28. The left strike off plate portion similarly includes a left laterally outer end 128 (see FIG. 4) which is similarly attached to the left side plate assembly 26.

The strike off assembly 30 further includes a plurality of strike off actuators, including left end, center and right end actuators 130, 132 and 134, respectively, connected to the strike off plate assembly 104 and configured to raise and lower the strike off plate assembly 104 relative to the support beam 66 to vary a height of the material placement space 74. The material placement space 74 is schematically represented in FIGS. 9 and 10 within the dashed outline, and is defined between the side plate assemblies 26 and 28 on the laterally outer ends, the lower edge of the strike off plate assembly 104 on the upper end and the ground surface on the lower end.

FIGS. 9 and 10 are front elevation views of the strike off assembly 30 in a negative crowning mode and a positive crowning mode, respectively. References to left and right sides of the strike off assembly 30 are reversed with reference to the left and right sides of FIGS. 9 and 10 because they are front views. As best seen in FIGS. 9 and 10 the left end actuator 130 is connected between the left side plate assembly 26 and the left laterally outer end 128 of the left strike off plate portion 106 for raising and lowering the left laterally outer end 128 of the left strike off plate portion 106 relative to the support beam 66. The right end actuator 134 is connected between the right side plate assembly 28 and the right laterally outer end 120 of the right strike off plate portion 108 for raising and lowering the right laterally outer end 120 of the right strike off plate portion 108 relative to the support beam 66. The center actuator 132 is connected between a mounting bracket 136 attached to the center beam portion 76 of the support beam 66 and a central guide plate 138. The central guide plate 138 has the pivot pin 112 mounted therein so that the center actuator 132 can raise and lower the laterally inner ends 114 and 116 of the left and right strike off plate portions 106 and 108, which may also be described as raising and lowering a center of the strike off plate assembly 104.

As can be appreciated in viewing FIGS. 9 and 10, the left end actuator 130, center actuator 132 and right end actuator 134 are operable independently of each other.

Each of the actuators 130, 132 and 134 may have an extension sensor associated therewith to measure an extension of the actuator. Thus the left end actuator 130 may have a left end actuator extension sensor 130S associated therewith and configured to generate a left end extension signal representative of an extension distance of the left end actuator 130. The center actuator 132 may have a center actuator extension sensor 132S associated therewith and configured to generate a center extension signal representative of an extension distance of the center actuator 132. The right end actuator 134 may have a right end actuator extension sensor 134S associated therewith and configured to generate a right end extension signal representative of an extension distance of the right end actuator 134.

The actuators may be hydraulic piston-cylinder type actuators, or any other suitable type of linear actuator. If the actuators are hydraulic piston-cylinder units they may be configured as "smart cylinders" in which their respective actuator extension sensors are integrally located within the hydraulic piston-cylinder type actuators as described below.

Figure 16:
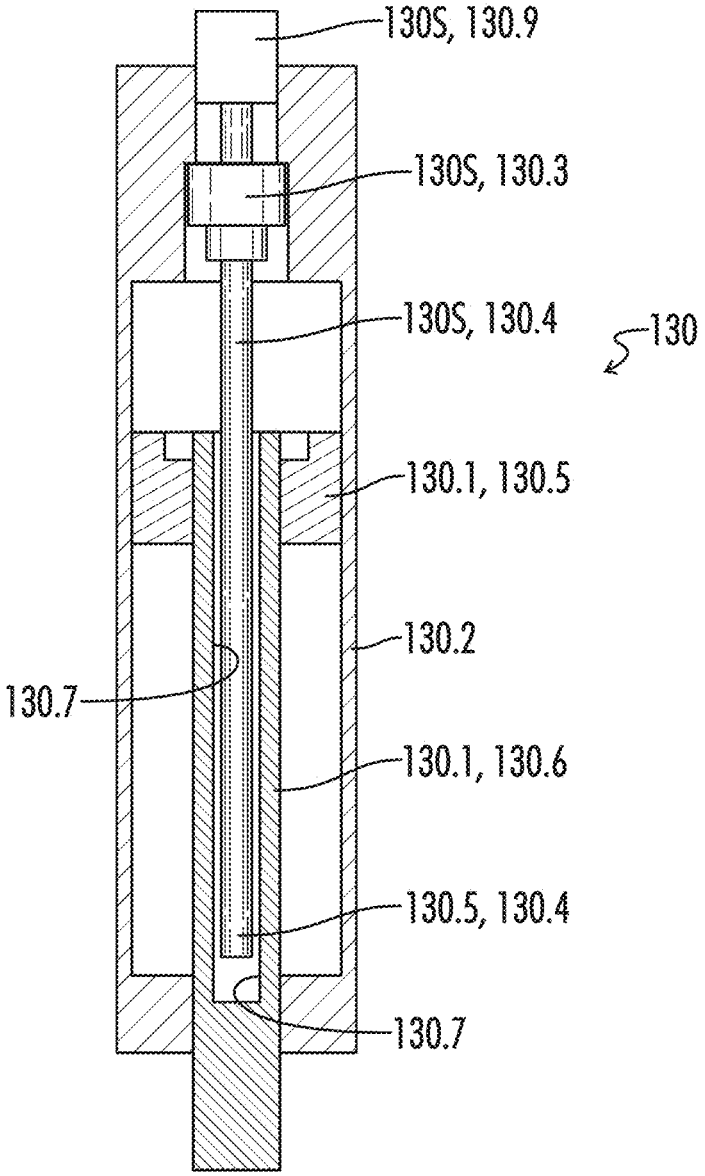
FIG. 16 is a schematic illustration of a hydraulic piston-cylinder type actuator with an integral position sensor, which is sometimes referred to as a "smart cylinder."

FIG. 16 further schematically illustrates the internal construction of the actuator 130 and is also representative of the internal construction of the other actuators herein described. In the illustrated embodiment, the actuator 130 is of a type sometimes referred to as "smart cylinder" which includes an integrated sensor 130S configured to provide a signal corresponding to an extension of a piston member 130.1 relative to the cylinder member 130.2 of the actuator 130.

The sensor 130S includes a position sensor electronics housing 130.3 and a position sensor coil element 130.4.

The piston portion 130.1 of actuator 130 includes a piston 130.5 and a rod 130.6. The piston 130.5 and rod 130.6 have a bore 130.7 defined therein, within which is received the piston sensor coil element 130.4.

The actuator 130 is constructed such that a signal is provided at connector 130.9 representative of the position of the piston 130.5 relative to the position sensor coil element 130.4.

Such smart cylinders may operate on several different physical principles. Examples of such smart cylinders include but are not limited to magnetostrictive sensing, magnetoresistive sensing, resistitve (potentiometric) sensing, Hall effect sensing, sensing using linear variable differential transformers, and sensing using linear variable inductance transducers.

Figure 12:
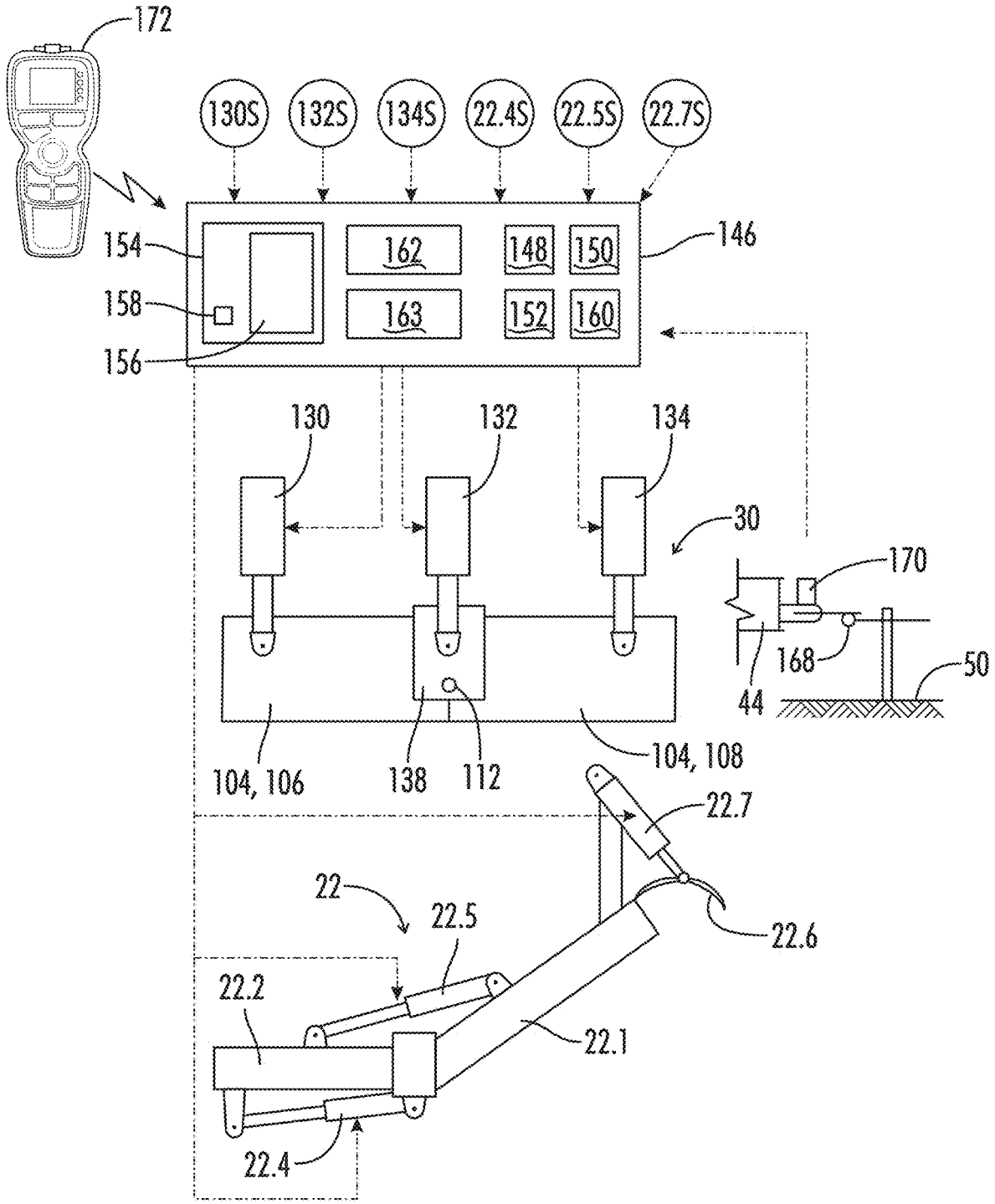
FIG. 12 is a schematic illustration of the controller with associated inputs and outputs.

The Controller:

As schematically shown in FIG. 12, the placer spreader machine 12 may include a controller 146 configured to receive the extension signals from the actuator extension sensors 130S, 132S and 134S and to generate control signals for each of the actuators 130, 132 and 134 based at least in part on the extension signal of its respective extension sensor and based at least in part on target values corresponding to a user selected profile for the height of the material placement space 74. The controller 146 may be a part of the machine control system of placer spreader machine 12, or it may be a separate control module. The controller 146 may be located at the operator's platform 62. The controller 146 may be located remotely from the placer spreader machine 12.

The controller 146 receives input signals from the actuator extension sensors 130S, 132S and 134S as schematically illustrated in FIG. 12.

The controller 146 may also receive other signals indicative of various functions of the placer spreader machine 12. The signals transmitted from the various sensors to the controller 146 are schematically indicated in FIG. 12 by phantom lines connecting the sensors to the controller with an arrowhead indicating the flow of the signal from the sensor to the controller.

Similarly, the controller 146 will generate command signals for controlling the operation of the various actuators, which command signals are indicated schematically in FIG. 12 by phantom lines connecting the controller to the various actuators with the arrow indicating the flow of the command signal from the controller 146 to the respective actuator. It will be understood that the various actuators as disclosed herein may be hydraulic piston-cylinder units and that the electronic control signal from the controller 146 will actually be received by a hydraulic control valve associated with the actuator and the hydraulic control valve will control the flow of hydraulic fluid to and from the hydraulic actuators to control the actuation thereof in response to the command signal from the controller 146.

Furthermore, the controller 146 may control the direction of travel of the placer spreader machine 12 by selective advancement of the ground engaging units 46 and 48 via a conventional steering system (not shown). Communication of such steering signals from the controller 146 to the ground engaging units 46 and 48 is performed in a conventional manner. The controller 146 may also control the operation of the spreading auger 25 and the lateral conveyor 22.

Controller 146 includes or may be associated with a processor 148, a computer readable medium 150, a data base 152 and an input/output module or control panel 154 having a display 156. An input/output device 158, such as a keyboard or other user interface, is provided so that the human operator may input instructions to the controller. It is understood that the controller 146 described herein may be a single controller having all of the described functionality, or it may include multiple controllers wherein the described functionality is distributed among the multiple controllers.

Various operations, steps or algorithms as described in connection with the controller 146 can be embodied directly in hardware, in a computer program product 160 such as a software module executed by the processor 146, or in a combination of the two. The computer program product 160 can reside in RAM memory, flash memory, ROM memory, EPROM memory, EEPROM memory, registers, hard disk, a removable disk, or any other form of computer-readable medium 150 known in the art. An exemplary computer-readable medium 150 can be coupled to the processor 146 such that the processor can read information from, and write information to, the memory/storage medium. In the alternative, the medium can be integral to the processor. The processor and the medium can reside in an application specific integrated circuit (ASIC). The ASIC can reside in a user terminal. In the alternative, the processor and the medium can reside as discrete components in a user terminal.

The term "processor" as used herein may refer to at least general-purpose or specific-purpose processing devices and/or logic as may be understood by one of skill in the art, including but not limited to a microprocessor, a microcontroller, a state machine, and the like. A processor can also be implemented as a combination of computing devices, e.g., a combination of a DSP and a microprocessor, a plurality of microprocessors, one or more microprocessors in conjunction with a DSP core, or any other such configuration.

With regard to controlling the height of the strike off plate assembly 104, the controller 146 has multiple modes of operation. As previously noted the left end actuator 130, center actuator 132 and right end actuator 134 are each independently controllable. Each of the modes of operation described below can be based on direct control of each actuator by the human operator via the controller 146. Each of the modes of operation described below can also be implemented based upon selection by the human operator of a preprogrammed mode of operation. Control can also be based upon a preprogramming of the controller 146 with a desired profile of the strike off plate assembly 104 corresponding to a specific location of the placer spreader machine 12 within an external reference system.

Figure 14:
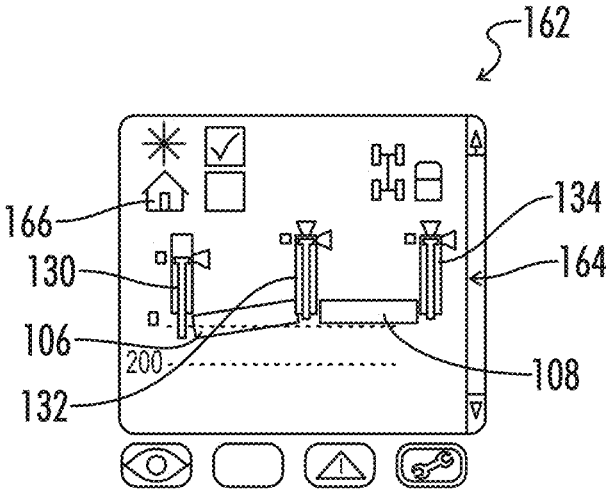
FIG. 14 is a schematic illustration of a control screen of the controller showing a graphical representation of the extension positions of the hydraulic actuators of the strike off assembly.

The controller 146 may include a strike off control screen 162 which is schematically shown in detail in FIG. 14. The strike off control screen 162 may include a graphical and numeric display 164 of a representation of the extension positions of the actuators 130, 132 and 134 along with the corresponding orientations of the left and right strike off plate portions 106 and 108. Through the various input controls the human operator may either manually direct the position of each actuator, or the human operator may select automatic implementation of one of the modes of operation described below.

Each of the modes of operation described below may be referred to as controlling the actuators 130, 132 and 134 based upon a set of target values corresponding to a user selected profile for the height of the material placement space 74.

In a first mode of operation, which may be referred to as a horizontal mode, the left and right strike off plate portions 106 and 108 may have their lower edges aligned horizontally (assuming the main frame 44 is oriented horizontally), and the actuators 132, 134 and 136 may be retracted or extended simultaneously at equal rates to raise or lower the strike off plate assembly 104 to vary the height of the material placement space 74.

In a second mode of operation, which may be referred to as a positive crowning mode, as seen for example in FIG. 10, the center actuator 132 may be retracted further than the left end and right end actuators 130 and 134, or alternatively the left end and right end actuators 130 and 134 may be extended further than the center actuator 132, to form a crown in the material placement space.

In a third mode of operation, which may be referred to as a negative crowning mode, as seen for example in FIG. 9, the center actuator 132 may be extended further than the left end and right end actuators 130 and 134, or alternatively the left end and right end actuators 130 and 134 may be retracted further than the center actuator 132, to form a trough in the material placement space 74.

Either of the positive crowning mode or the negative crowning mode may be referred to as a crowning mode. Thus the set of target values can be described as including a crowning mode wherein the controller 146 is configured to vary a relative height between the center of the strike off plate assembly 104 and the laterally outer ends 120 and 128 of the strike off plate assembly 104 to form a crown or a trough in the material placement space. The controller 146 may be preprogrammed to form a specific crown, e.g. a positive 2% crown or a negative 2% crown. The human operator may input a selected percentage of crowning to be automatically implemented by the controller.

In a fourth mode of operation, which may be referred to as an incline mode, one of the left and right end actuators may be retracted, and the other of the left and right end actuators 130 and 134 may be extended relative to the center actuator 132, so that the lower edge of the strike off plate assembly 104 is inclined toward one side or the other of the placer spreader machine 12, relative to the main frame 44. This might be done for example on a curved roadway so the roadway drains toward the inside of the curve and to aid the traction of vehicles moving through the curve at high speed. Thus the set of target values can be described as including an incline mode wherein the controller 146 is configured to laterally incline the strike off plate assembly 104 relative to the support beam 66.

In a fifth mode of operation, such as shown in the graphical illustration in FIG. 14, one of the left and right strike off plate portions 106 and 108 may be oriented horizontally and the other may be inclined.

Any of these modes of operation, such as for example the horizontal mode, can be defined as a home position mode wherein the controller 146 returns each of the actuators to a preset home position upon engagement of the "home" button 166. Thus the set of target values can be described as including a home position mode wherein the controller 146 returns each of the actuators 130, 132 and 134 to a preset home position.

As previously noted, the set of target values may include an adjustment of the extension distance of one or more of the actuators directed by a human operator.

Figure 15:
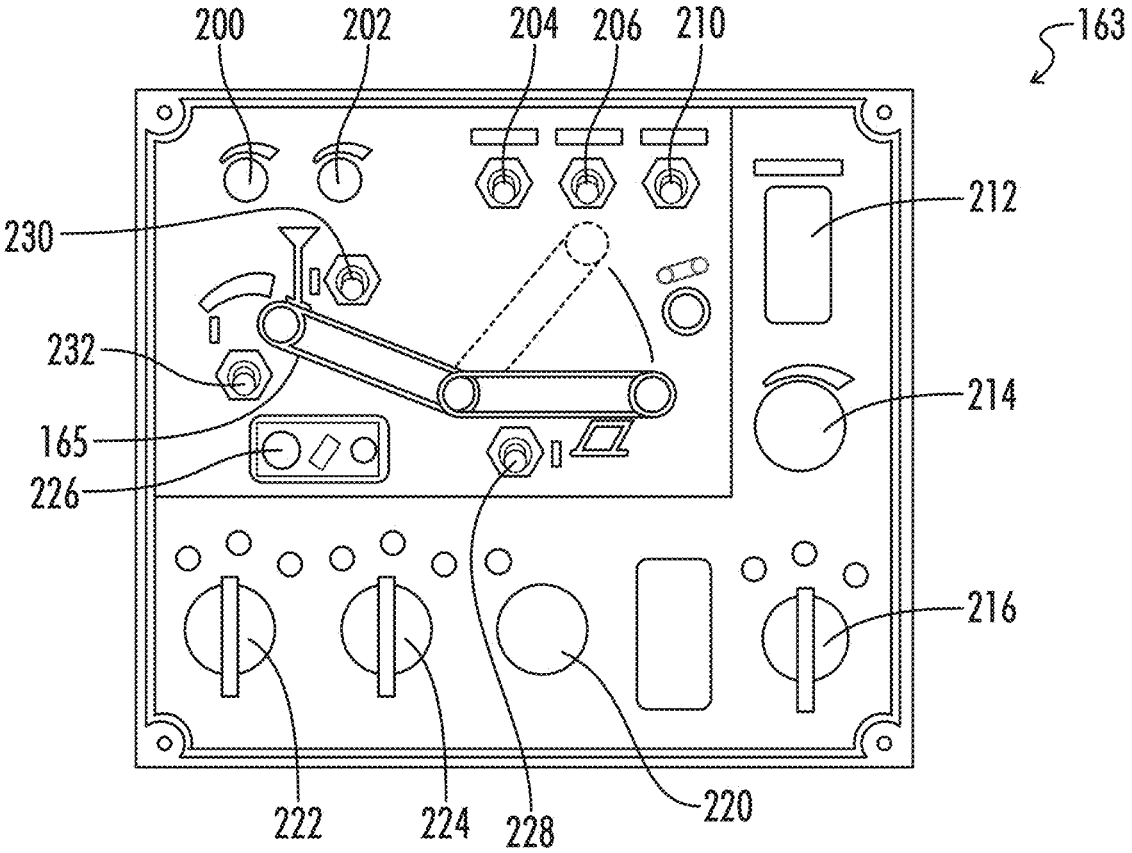
FIG. 15 is a schematic illustration of a control dashboard of the controller showing a graphic representation of the folded position of the lateral conveyor of the placer spreader machine.

The controller 146 may also include a control dashboard 163, the details of which are best seen in FIG. 15, for controlling the various aspects of the strike off assembly 30 including the strike off plate assembly 104, the lateral conveyor 22, and the augers 25. Control dashboard 163 may include a graphical display 165 of the foldable lateral conveyor 22.

Knobs 200 and 202 may control the auger speed of left and right portions of the auger 25. Switches 204, 206 and 208 may individually control the up or down movement of each of the actuators 130, 132 and 134, respectively, of the strike off plate assembly 104. Switch 212 can simultaneously move all three of the actuators 130, 132 and 134 up or down. Knob 214 controls the conveyor speed. Switch 216 controls the forward or reverse direction of the conveyor 22. Switch 218 controls the pivoting of the conveyor 22. Button 220 is the main power on/off switch. Switch 222 is the forward/reverse switch for the left side auger 25. Switch 224 is the forward/reverse switch for the right side auger 25. Button 226 activates or deactivates the remote control 172.

Switches 228, 230 and 232 may control the operation of hydraulic cylinders 22.4, 22.5 and 22.7, respectively, of conveyor 22. Each of the hydraulic cylinders 22.4, 22.5 and 22.7 may be a "smart cylinder" having integrated extension sensors 22.4S, 22.5S and 22.7S which generate extension signals which are communicated back to the controller 146. Extension of each of the hydraulic cylinders 22.4, 22.5 and 22.7 may be controlled by control signals generated by controller 146.

When the placer spreader machine 12 is used in the paving train 10 as seen in FIG. 1, each of the placer spreader machine 12, the paving machine 14 and the texturing and curing machine 16 may be guided along a predetermined common path with reference to a common external position reference. For example the common external position reference may be a stringline 168 fixed relative to the ground surface 50 adjacent the predetermined common path as schematically shown in FIG. 12. The placer spreader machine 12 may include a stringline sensor 170, schematically shown in FIG. 12, which generates position signals which are directed to controller 146. Based upon the position signals from the stringline sensor 170 the controller 146 may steer the placer spreader machine along the path and may adjust the height of the main frame 44 relative to the ground surface.

Alternatively the placer spreader machine 12 may be directed along the path using satellite based position signals, such as from a global navigation satellite system (GNSS). Further alternatively the placer spreader machine 12 may be guided along the path by a Total Station.

Figure 13:
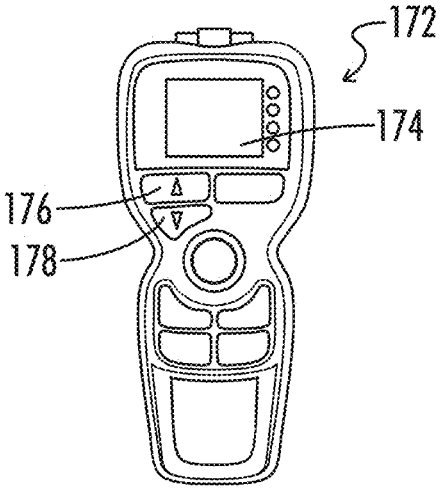
FIG. 13 is a remote control unit for use with the controller.

The controller 146 may optionally be implemented in the form of a remote control unit 172, or may include a remote control unit 172 in addition to the controller 146. The remote control unit 172 is best shown in FIG. 13. For example the remote control unit 172 may include function keys F1, F2, F3 and F4. As indicated in the display screen 174 function keys F1, F2 and F3 may correspond to selection of the left end actuator 130, right end actuator 134 or the center actuator 132, respectively, for actuation. F4 may correspond to simultaneous actuation of all actuators. Then the selected actuator or actuators may be retracted or extended using the up and down buttons 176 and 178.

The remote control unit 172 may be operated by a human operator located on the placer spreader machine 12 or walking alongside the placer spreader machine 12. In one embodiment of the methods of the present invention, a human operator of the slip form paving machine 14 following the placer spreader machine 12 may utilize the remote control unit 172 to also control the placer spreader machine 12. Thus the human operator located on the slip form paving machine 14 may observe that the paving operation could be improved by changing the profile of the rough formed concrete structure 32, and the human operator may direct that change using the remote control unit 172.

For example, the placer spreader machine 12 and the slip form paving machine 14 may both be following the same stringline 168 along the path which is to be paved. The height of the main frame 44 and thus of the strike off assembly 30 may be adjusted by the controller 146 in response to signals from the stringline sensor 170. The slip form paving machine 14 may also be controlling its path and height based on the same stringline 168. If the planned profile of the pavement is inclined in a curved portion of the path, the human operator located on the slip form paving machine 14 may observe that due to an overly wet batch of concrete that the material in the rough formed concrete structure 32 is flowing too much toward the downslope side. Thus the human operator may direct the strike off plate assembly 104 to incline so as to force more material to the upslope side of the rough formed concrete structure 32.

Such a method may be described as a method of coordinating operation of a slip form paving machine and a placer spreader machine, the method comprising steps of:

(a) providing a paving train 10 including the placer spreader machine 12 followed by the slip form paving machine 14, each of the placer spreader machine 12 and the slip form paving machine 14 including a machine frame 44, 14.1, a plurality of ground engaging units 46-48, 14.2-14.4, and a plurality of lifting columns 52-58, 14.5-14.8, supporting the respective machine frame from the respective plurality of ground engaging units;

(b) guiding each of the slip form paving machine 14 and the placer spreader machine 12 along a common path and controlling a machine frame height of each of the machine frames based upon a common external position reference 168;

(c) operating the slip form paving machine 14 with a human operator located on the slip form paving machine 14; and (d) remotely adjusting a height of the strike off plate assembly 104 relative to the machine frame 44 of the placer spreader machine 12 via the remote control 172 operated by the human operator located on the slip form paving machine 14.

Not only is it helpful during paving operations that the strike off assembly 30 may be controlled from the paving machine 14 following the placer spreader machine, or from another remote location, but also the use of the remote control 172 is helpful during set up of the placer spreader machine. In the past two human operators were needed during set up of the placer spreader machine, one for taking measurements around and even under the placer spreader machine and the other for activating control signals at the control panel of the paving machine according to the needs communicated by the first operator. With the remote control 172 a single human operator can set up the placer spreader machine.

Width Adjustment:

As previously noted the main frame 44 of the placer spreader machine 12 may be a laterally telescoping main frame such that the width of the placer spreader machine 12 can be adjusted. And as also noted above the support beam 66 of the strike off assembly 30 is designed to telescope with any change in width of the main frame 44. Other components of the placer spreader machine 12, including the strike off plate assembly 104 and the spreading auger 25 are designed in segments so that their width can be incrementally changed by adding or deleting one or more segments.

Figure 11:
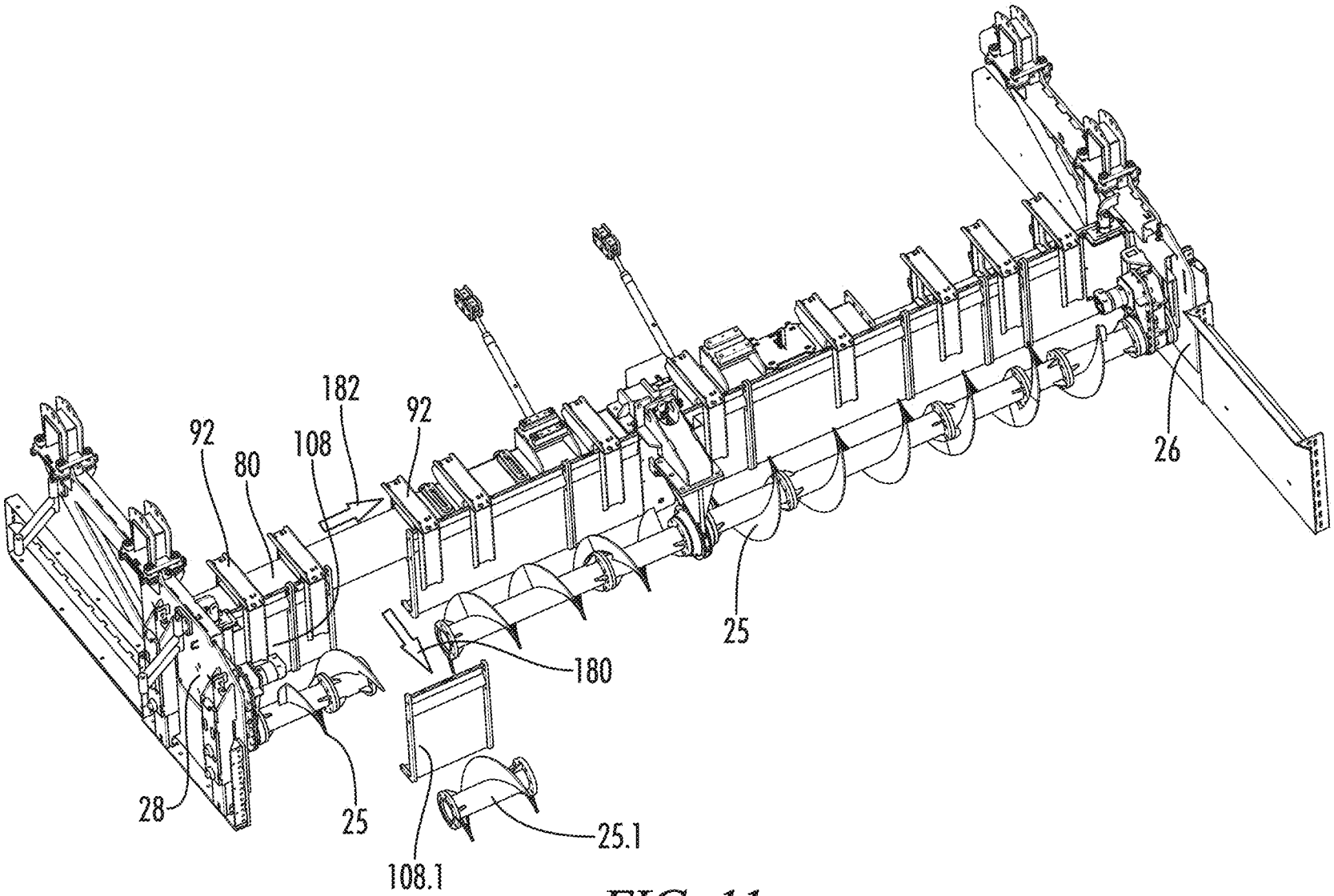
FIG. 11 is a perspective schematic exploded view illustrating the removal of a segment of the strike off assembly to adjust a length of the strike off assembly.

FIG. 11 is a front right side perspective view in partially exploded form illustrating the removal of a segment 108.1 of the right strike off plate portion 108 and a segment 25.1 of the spreading auger 25. The segment 25.1 of the spreading auger 25 and the segment 108.1 of the right strike off plate portion 108 have been unbolted from their respective assemblies and are removed as indicated by arrow 180. Prior to removal of the segment 108.1 any of the right strike off segment guide brackets 92 adjacent the segment 108.1 are loosened from telescoping support beam 66 and moved aside.

Then the remaining segments of the right strike off plate portion 108 and the spreading auger 25 are moved back together by retracting the telescoping machine frame 44 and the support beam 66 along with it as indicated by arrow 182, and those parts are bolted back together. The right strike off segment guide brackets 92 are reinstalled. To extend the length of the right strike off plate portion 108 and the spreading auger 25 this process is reversed. Thus a length of each of the left and right strike off plate portions 106 and 108, and a length of the spreading auger 25 can be varied by removing or adding segments to each.

Thus, it is seen that the apparatus and methods of the present invention readily achieve the ends and advantages mentioned as well as those inherent therein. While certain preferred embodiments of the present invention have been illustrated and described for purposes of the present disclosure, numerous changes in the arrangement and construction of parts and steps may be made by those skilled in the art which changes are encompassed within the scope and spirit of the present invention as defined by the appended claims.

What is claimed is:

1. A strike off assembly for a placer spreader apparatus, the strike off assembly comprising:

a strike off support beam including left and right beam ends, the support beam having a length between the beam ends;

left and right side plate assemblies supported from the support beam and configured to close off lateral sides of a material placement space;

a strike off plate assembly including a left strike off plate portion and a right strike off plate portion, the left and right strike off plate portions being pivotable relative to each other and relative to the support beam about at least one pivot axis; and a plurality of strike off actuators connected to between the support beam and the strike off plate assembly and configured to raise and lower the strike off plate assembly relative to the support beam to vary a height of the material placement sp ace.

2. The strike off assembly of claim 1, wherein:

the plurality of strike off actuators includes:

a left end actuator for raising and lowering a left laterally outer end of the strike off plate assembly relative to the support beam;

a right end actuator for raising and lowering a right laterally outer end of the strike off plate assembly relative to the support beam; and a center actuator for raising and lowering a center of the strike off plate assembly relative to the support beam.

3. The strike off assembly of claim 2, wherein:

laterally inner ends of the left and right strike off plate portions are pivotally connected to each other at a pivot connection defining the at least one pivot axis; and the center actuator is configured to raise and lower the pivot connection relative to the support beam.

4. The strike off assembly of claim 2, wherein:

each of the left end actuator, the right end actuator and the center actuator is operable independently of the others.

5. The strike off assembly of claim 2, further comprising:

a left end actuator extension sensor associated with the left end actuator and configured to generate a left end extension signal representative of an extension distance of the left end actuator;

a right end actuator extension sensor associated with the right end actuator and configured to generate a right end extension signal representative of an extension distance of the right end actuator; and a center actuator extension sensor associated with the center actuator and configured to generate a center extension signal representative of an extension distance of the center actuator.

6. The strike off assembly of claim 5, wherein:

each of the actuators includes a hydraulic piston-cylinder unit, and each actuator extension sensor is integrally located within its respective hydraulic piston-cylinder unit.

7. The strike off assembly of claim 5, further comprising:

a controller configured to receive the extension signals from the actuator extension sensors and to generate control signals for each of the actuators based at least in part on the extension signal of its respective extension sensor and based at least in part on target values corresponding to a user selected profile for the height of the material placement space.

8. The strike off assembly of claim 7, wherein:

the target values include a home position mode wherein the controller returns each of the actuators to a preset home position.

9. The strike off assembly of claim 7, wherein:

the target values include a crowning mode wherein the controller is configured to vary a relative height between the center of the strike off plate assembly and the laterally outer ends of the strike off plate assembly to form a crown or a trough in the material placement space.

10. The strike off assembly of claim 7, wherein:

the target values include an incline mode wherein the controller is configured to laterally incline the strike off plate assembly relative to the support beam.

11. The strike off assembly of claim 7, wherein:

the target values include an adjustment of the extension distance of one or more of the actuators directed by a human operator.

12. The strike off assembly of claim 11, wherein:

the controller further includes a remote control unit configured such that the human operator can control the strike off assembly from a paving machine following the placer spreader apparatus.

13. The strike off assembly of claim 1, wherein:

the strike off support beam is a telescoping strike off support beam such that the length of the beam is adjustable.

14. The strike off assembly of claim 13, wherein:

each of the left and right strike off plate portions includes a plurality of removable strike off segments so that a length of each of the left and right strike off plate portions can be varied by removing or adding a segment.

15. The strike off assembly of claim 13, further comprising:

a plurality of strike off segment guide brackets removably attached to the telescoping strike off support beam, each guide bracket including a downward extending member spaced forward from the support beam to define a guide gap between the support beam and the downward extending member, the guide gaps associated with each of the plurality of strike off segment guide brackets being aligned in a lateral direction parallel to the length of the support beam; and wherein the strike off plate assembly is received in the guide gaps.

16. The strike off assembly of claim 1, further comprising:

a spreading auger located forward of the strike off plate assembly for spreading material laterally in front of the strike off plate assembly; and a lateral conveyor including a receiving portion laterally offset from the strike off plate assembly for receiving the material from a transfer vehicle, and including a discharge portion located forward of the spreading auger for discharging the material onto a ground surface forward of the spreading auger.

17. The strike off assembly of claim 1, in combination with:

a tractor including a main frame, a plurality of ground engaging units for supporting the main frame from the ground surface, and a plurality of lifting columns extending between the ground engaging units and the main frame for adjusting a height of the main frame relative to the ground surface; and wherein the support beam is supported directly or indirectly from the main frame so that a height of the support beam is adjustable in height relative to the ground surface with the main frame;

wherein the strike off assembly further includes a plurality of actuator extension sensors, each sensor being associated with at least one of the actuators and configured to generate an extension signal representative of an extension distance of its respective actuator; and further including a controller configured to:

receive the extension signals from the extension sensors; and control the extension distances of the actuators to thereby control a height of the strike off plate assembly relative to the support beam at least in part in response to the extension signals and based at least in part on target values corresponding to a user selected profile for the height of the strike off plate assembly relative to the support beam.

18. A strike off assembly for a placer spreader apparatus, the strike off assembly comprising:

a telescoping strike off support beam including left and right beam ends, the support beam having an adjustable length between the beam ends;

left and right side plate assemblies attached to the left and right beam ends;

a plurality of strike off segment guide brackets attached to the strike off support beam, each guide bracket including a downward extending member spaced forward from the support beam to define a guide gap between the support beam and the downward extending member, the guide gaps associated with each of the plurality of strike off segment guide brackets being aligned in a lateral direction parallel to the length of the support beam; and a strike off plate assembly received in the guide gaps.

19. The strike off assembly of claim 18, wherein:

the telescoping strike off support beam includes a center beam portion including upper and lower laterally extending cavities, a left sliding beam portion telescopingly received in one of the cavities and a right sliding beam portion telescopingly received in the other of the cavities.

20. The strike off assembly of claim 18, further comprising:

a plurality of strike off actuators connected to the strike off plate assembly and configured to raise and lower the strike off plate assembly within the guide gaps relative to the support beam.

21. The strike off assembly of claim 20, wherein:

the strike off plate assembly includes a left strike off plate portion and a right strike off plate portion, the left and right strike off plate portions being pivotable relative to each other and relative to the support beam; and the plurality of strike off actuators includes:

a left end actuator for raising and lowering a left laterally outer end of the left strike off plate portion relative to the support beam;

a right end actuator for raising and lowering a right laterally outer end of the right strike off plate portion relative to the support beam; and a center actuator for raising and lowering laterally inner ends of the left and right strike off plate portions relative to the support beam.

22. The strike off assembly of claim 21, wherein:

the plurality of strike off actuators is configured to vary a relative height between the laterally inner ends of the left and right strike off plate portions and the left and right laterally outer ends of the left and right strike off plate portions to form a crown or a trough in a material placement space.

23. The strike off assembly of claim 21, wherein:

each of the left and right strike off plate portions includes a plurality of removable strike off segments so that a length of each of the left and right strike off plate portions can be varied by removing or adding one or more segments.

24. A method of coordinating operation of a slip form paving machine and a placer spreader machine, the method comprising:

(a) providing a paving train including the placer spreader machine followed by the slip form paving machine, each of the placer spreader machine and the slip form paving machine including a machine frame, a plurality of ground engaging units, and a plurality of lifting columns supporting the respective machine frame from the respective plurality of ground engaging units, the placer spreader machine including a strike off support beam including left and right beam ends, the support beam having a length between the beam ends, left and right side plate assemblies supported from the support beam and configured to close off lateral sides of a material placement space, a strike off plate assembly including a left strike off plate portion and a right strike off plate portion, the left and right strike off plate portions being pivotable relative to each other and relative to the support beam about at least one pivot axis, and a plurality of strike off actuators connected between the support beam and the strike off plate assembly and configured to raise and lower the strike off plate assembly relative to the support beam to vary a height of the material placement space;

(b) guiding each of the slip form paving machine and the placer spreader machine along a common path and controlling a machine frame height of each of the machine frames based upon a common external position reference;

(c) operating the slip form paving machine with a human operator located on the slip form paving machine; and (d) remotely adjusting a height of the strike off plate assembly of the placer spreader machine relative to the strike off support beam and the machine frame of the placer spreader machine via a remote control operated by the human operator located on the slip form paving machine.

25. The method of claim 24, wherein:

in step (b) the common external position reference includes a stringline fixed relative to the ground surface.

26. The method of claim 24, wherein:

in step (d) the adjusting of the height of the strike off plate assembly includes forming a crown in the material placement space.

27. The method of claim 24, wherein:

in step (d) the adjusting of the height of the strike off plate assembly includes forming an incline in the material placement space.

* * * * *